US006072305A

United States Patent [19]

Trainor et al.

[11] Patent Number: 6,072,305

[45] Date of Patent: Jun. 6, 2000

[54] ELECTRONIC TAP POSITION INDICATION SYSTEM

[75] Inventors: John Joseph Trainor, Wake Forest, N.C.; Franz Steven Roesner, Ridgeland, Miss.

[73] Assignee: Siemens Power Transmission & Distribution, Inc., Wendell, N.C.

[21] Appl. No.: 09/163,100

[22] Filed: Sep. 29, 1998

[51] Int. Cl.[7] ..... G05F 1/14

[52] U.S. Cl. ..... 323/255; 323/340

[58] Field of Search ..... 323/255, 256, 323/257, 263, 260, 258, 340, 341, 343; 307/31, 32; 364/483, 492

[56] References Cited

U.S. PATENT DOCUMENTS

| | | | |
|---|---|---|---|
| 5,428,551 | 6/1995 | Trainor et al. | 364/483 |
| 5,581,173 | 12/1996 | Yalla et al. | 323/257 |
| 5,619,121 | 4/1997 | Trainor | 323/256 |
| 5,633,580 | 5/1997 | Trainor et al. | 323/256 |
| 5,804,954 | 9/1998 | Laplace, Jr. | 323/256 |

OTHER PUBLICATIONS

J. H. Harlow, A microcomputer control for step–voltage regulations, IEEE, vol. PAS–104, No. 3, Mar. 1985.

*Primary Examiner*—Adolf Denske Berhane

[57] ABSTRACT

A system for indicating the position of a tap of a voltage regulator system. An electrical signal representing the tap position is converted to a digital format and provided to a processor which controls an electronic display. The display provides a graphical representation of the tap position. As the tap position changes, the processor samples the tap position data and upon determining that the tap has settled at a position, updates the display accordingly. The processor also keeps track of the minimum and maximum tap positions and displays those as "drag-hand" positions on the tap position display. The displayed "drag-hand" positions are reset in accordance with a signal received from a user-operated reset switch. The tap position indication system can also communicate tap position information via a data port and provide variable-amperage control. The data port can also be used to reset the "drag-hand" positions and to communicate variable-amperage information and settings (e.g., raise and lower limit settings).

31 Claims, 3 Drawing Sheets

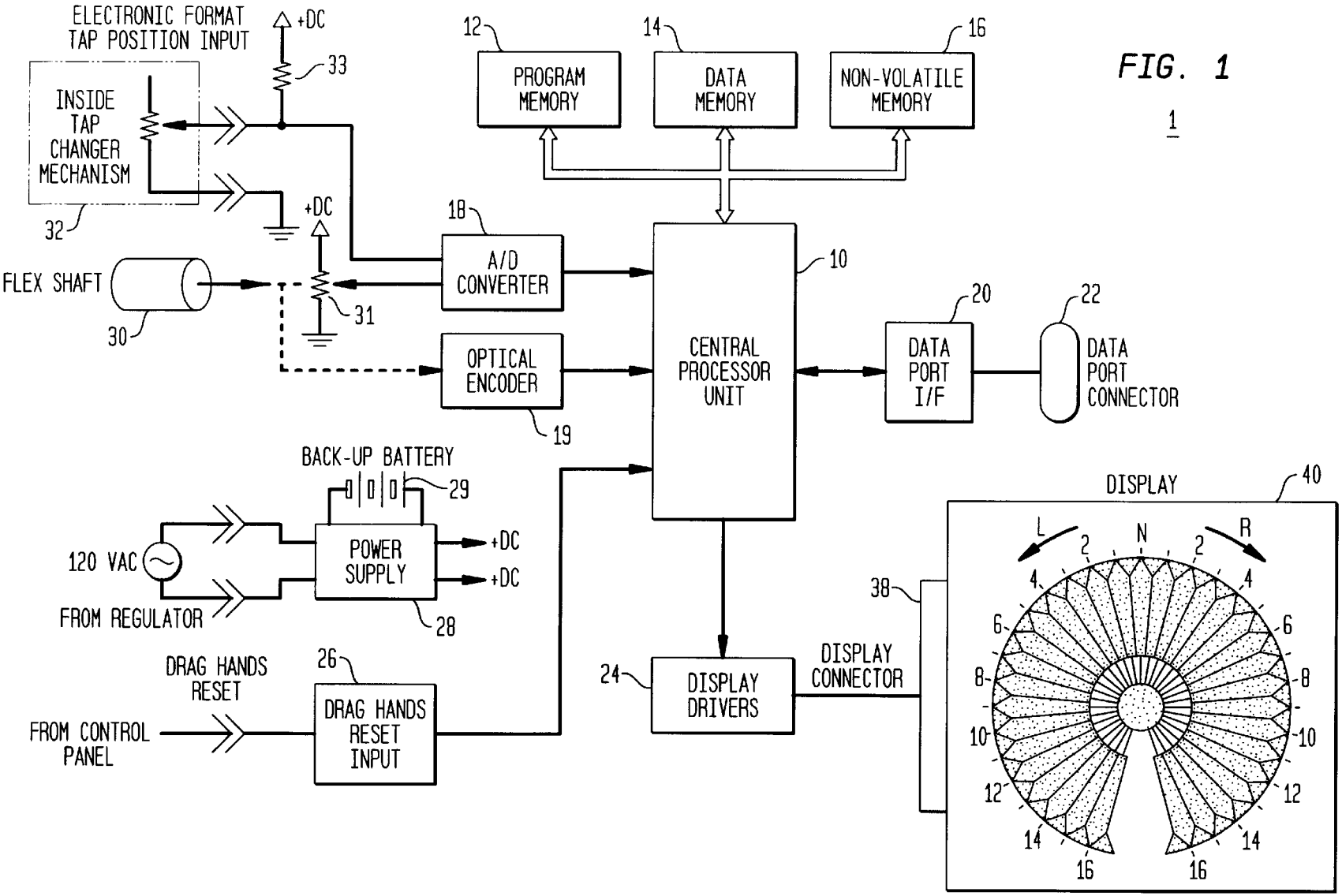
FIG. 1
1
NON-VOLATILE MEMORY
16
DATA MEMORY
14
PROGRAM MEMORY
12
CENTRAL PROCESSOR UNIT
10
DATA PORT I/F
20
DATA PORT CONNECTOR
22
DISPLAY
40
DISPLAY CONNECTOR
38
DISPLAY DRIVERS
24
A/D CONVERTER
18
OPTICAL ENCODER
19
BACK-UP BATTERY
29
POWER SUPPLY
28
+DC
+DC
DRAG HANDS RESET INPUT
26
DRAG HANDS RESET
FROM CONTROL PANEL
120 VAC
FROM REGULATOR
+DC
33
+DC
31
ELECTRONIC FORMAT TAP POSITION INPUT
INSIDE TAP CHANGER MECHANISM
32
FLEX SHAFT
30
L
N
R DISPLAY
40
L
N
R
LLS
RLS
38
DISPLAY CONNECTOR
DISPLAY DRIVERS
24
CENTRAL PROCESSOR UNIT
10
81
82
83
84
90
M
FROM CONTROL PANEL

ELECTRONIC TAP POSITION INDICATION SYSTEM

FIELD OF THE INVENTION

The present invention relates to a tap position indication system for a tap changer of a transformer in a voltage regulator system.

BACKGROUND INFORMATION

Conventional tap position indicators are implemented as electromechanical devices. Conventional implementations of tap position indicators use mechanical components to indicate the tap position on a circular dial. Gears, bearings, and other mechanical components are used to display the present, minimum and maximum tap position values. In one such implementation, mechanical means are used to track the maximum and minimum ("drag hands") positions. The operator resets the drag-hand readings using a control panel switch, which activates a solenoid to return the drag-hands to the current tap position. The solenoid also includes moving parts and like the display mechanism is subject to reliability and longevity problems.

The reliability and longevity problems of conventional tap position indicators make them costly to maintain and necessitate frequent replacement. Additionally, conventional electromechanical tap position indicators are costly to manufacture.

Electromechanical tap monitoring systems are described in U.S. Pat. Nos. 5,428,551, 5,619,121 and 5,633,580.

SUMMARY OF THE INVENTION

The present invention is directed to an electronic tap position indication system which overcomes the shortcomings of known tap position indicators.

The tap position indication system of the present invention uses electronic components to indicate the tap position and to track the maximum and minimum ("drag-hands") positions. An operator can reset the drag-hand readings using a control panel switch which initiates an electronic reset of the drag-hands display to the current tap position.

The tap position indication system of the present invention eliminates many of the moving parts of conventional electromechanical tap position indicators. For example, the tap position needle and drag-hands are eliminated, as is the solenoid for resetting the drag-hands.

Furthermore, the tap position indication system of the present invention can accept tap position information in a mechanical or electrical format. Like conventional tap position indicators, the system of the present invention can accept "flexible shaft" input for tap position data. In addition, the system of the present invention can also accept an electronic signal or signals bearing tap position information.

Furthermore, unlike known electromechanical devices, the tap position indication system of the present invention can communicate tap position data to other devices.

A further embodiment of a system in accordance with the present invention provides variable-amperage control.

BRIEF DESCRIPTION OF THE DRAWINGS

FIG. 1 is a block diagram of an exemplary embodiment of a tap position indication system in accordance with the present invention.

DETAILED DESCRIPTION

Figure 2:
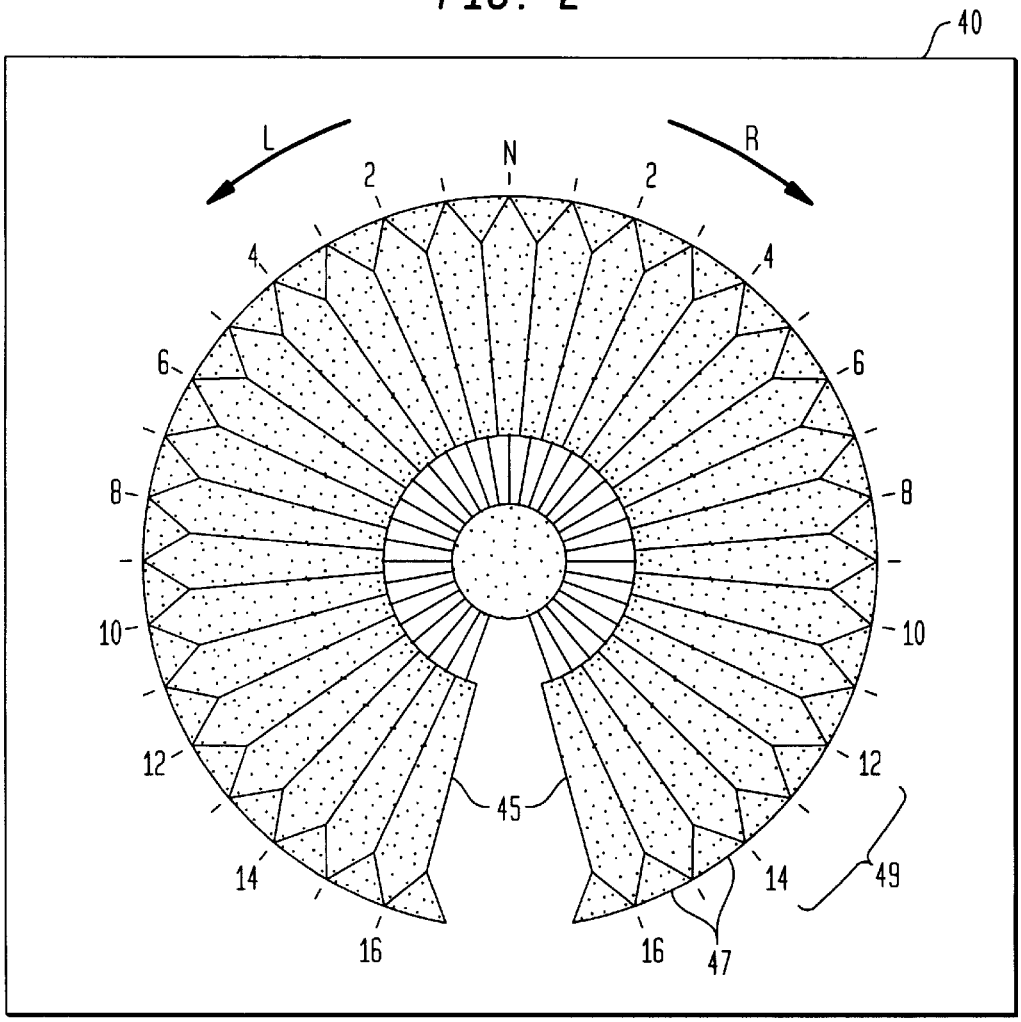
FIG. 2 shows an exemplary display format of a tap position display in accordance with the present invention.

A block diagram of an exemplary tap position indication system 1 in accordance with the present invention is shown in FIG. 1. Tap position information can be provided to the system 1 from a regulator system (not shown) via a flex shaft 30. The shaft 30 provides a rotating input to the tap position indication system 1. As will be described more fully below, the system 1 converts the rotating (mechanical) input to an electronic format. Using the electronic format tap position information, the system 1 displays the present tap position. Using an internal program and memory, the system 1 tracks and displays the minimum and maximum values of the tap position. The system 1 accepts an input for resetting the tap minimum and maximum values to the present tap position value.

In the exemplary embodiment of FIG. 1, the system 1 includes a central processing unit (CPU) 10, for controlling the system and for processing data; a program memory 12 for storing a program (i.e., "firmware") executed by the CPU 10; a data memory 14 for temporarily storing data; a non-volatile memory 16 for providing non-volatile storage of data; an analog-to-digital (A/D) converter 18 or an optical encoder 19 for generating a digital representation of the tap position; a data port interface 20 and a data port connector 22 for allowing the system 1 to communicate with other devices; display drivers 24 for driving a display 40; a power supply 28; and a "drag hands" reset input 26.

In the exemplary embodiment of FIG. 1, the flex shaft 30, whose rotational position is indicative of the tap position, drives a potentiometer 31. The flex shaft can be mechanically linked to the shaft of the potentiometer 31 such as with a plastic linkage component. The potentiometer 31 is preferably a single-turn potentiometer. The rotating flex shaft 30 turns the potentiometer shaft and thus the potentiometer wiper contact. With the potentiometer 31 connected across a DC voltage source, a rotation of the shaft 30 causes the voltage developed at the potentiometer wiper contact to change accordingly. The potentiometer wiper is coupled to the analog input of an A/D converter 18 which generates a digital representation of the voltage at its analog input.

In an alternative embodiment, the potentiometer 31 and A/D converter 18 can be replaced with an optical encoder 19. The optical encoder 19 converts the rotational position of the flex shaft 30 to a binary format.

In a further alternative embodiment, the tap position information can be provided in an electrical format directly from the regulator. The information can be provided as a voltage level which is provided to the A/D converter 18. In an exemplary embodiment, a potentiometer 32 can be mounted at the tap changer mechanism and the voltage developed at the potentiometer wiper monitored to determine the tap position. In this embodiment, the system 1 provides a DC ground connection and a potentiometer wiper connection, whereby the system 1 supplies a DC bias voltage to the wiper (through a resistor 33), and monitors the wiper voltage with the analog input of the A/D converter 18.

The digital representation of the tap position that is generated by the A/D converter 18 or the optical encoder 19 is provided to the CPU 10 for processing. In an exemplary embodiment, 6 bits are sufficient to represent the position of the tap. This allows the system 1 to indicate, for example, 16 "raise" positions, 16 "lower" positions and one "neutral" position.

In accordance with the program executed by the CPU 10, the CPU tracks, stores and controls the display of the tap position and the tap position minimum and maximum values. The non-volatile memory 16 is used to store the tap minimum and maximum values. The memory 16 can be implemented with an EEPROM.

The CPU 10 periodically reads the digital output of the A/D converter 18 which, as discussed, provides a digital representation of the tap position. The CPU 10 then uses a look-up table to determine which tap position corresponds to the input value read from the A/D converter 18. The CPU 10 then sets an internal tap position variable to that value.

The CPU 10 then compares the value of the tap position variable to the minimum and maximum values stored in the non-volatile memory 16. If the new value is beyond either of the stored minimum or maximum values, the software updates the stored minimum or maximum value accordingly. The CPU 10 updates the display of the drag-hands on the display 40 in accordance with the new stored minimum and maximum values.

The CPU 10 repeats the reading of the A/D converter 18 several times (e.g., once every 100 milliseconds). When the tap position value "settles" (e.g., stays the same for a predetermined number of consecutive readings), the CPU 10 then updates the display. The CPU 10 controls the display 40 to display the position of the tap in accordance with the data read from the A/D converter 18.

The process of reading the tap position information and displaying the tap position should occur fast enough so as to avoid any noticeable delay between changes in the actual and displayed tap positions. However, the process should incorporate sufficient latency so as to avoid bouncing between displayed tap position values while the tap position is changing.

The CPU 10 is coupled to the display drivers 24 which are coupled via a display connector 38 to the display 40. As mentioned, the display 40 provides a graphical representation of the current tap position and of the tap position minimum and maximum values. The display 40 is driven, in a known way, by the display drivers 24 in accordance with control signals from the CPU 10. An exemplary display format of the display 40 is described below with reference to FIG. 2. The display 40 can be implemented, for example, with a liquid crystal display (LCD) or with an array of light emitting diode (LED) segments.

For an LCD implementation of the display 40, the LCD should preferably be non-multiplexed (driven statically) for maximum operating temperature range. For outdoor installations, the LCD material should preferably be of a reflective type so as to provide improved contrast in bright sunlight and should preferably have a wide operating temperature range. LCD materials with a range of −30° C. to +70° C. or better are available and can be used.

To reset the position of the min/max drag hands shown on the display 40, the system 1 receives an input signal which is typically generated by a user-operable switch on a regulator control panel. Upon reset, the displayed positions of the drag-hands will coincide with the present tap position. In a typical control panel setup, the reset signal from the control panel is a nominal 120 VAC, on/off signal. This signal is provided to a level converter circuit 26 which converts the reset signal to a standard logic voltage level signal which is provided to an input of the CPU 10. Upon detecting the converted reset signal, the CPU 10 resets the display of the drag-hands on the display 40.

The exemplary embodiment of the tap position indication system 1 shown in FIG. 1 includes a data port for communicating tap position information to other devices or systems such as a regulator control panel. The CPU 10 is coupled to the data port interface 20 which is in turn coupled to a data port connector 22. Any appropriate standard data communications interface can be used, such as a serial RS-232 interface, for example. The minimum, maximum and present tap position data can be encoded by the CPU 10 in a standard format, such as ASCII or simple binary, and passed by the CPU 10 to the data port interface 20. The interface 20 handles the lower-level communications functions such as buffering and serializing the data and handling handshake signals (e.g., "request to send," "clear to send") for this communications port. The connector 22 can be a 9 pin D-type connector.

The data communications port can also be used to receive a reset signal for resetting the drag-hands positions displayed and to communicate variable-amperage information, as described below.

The CPU 10 can be implemented as a microcontroller which can incorporate in one chip some of the other functional blocks such as the A/D converter 18, the memories 12, 14 and 16, and the serial port 20. For example, a microcontroller such as the 68HC05 available from Motorola, Inc. can be used.

The system 1 can be powered from 120 VAC provided by the regulator (not shown). The 120 VAC is converted by the power supply circuit 28 which provides the appropriate regulated DC voltage (or voltages) to the various components of the system 1. A backup battery 29 can preferably be provided to power the tap indication system 1 in the case of a failure of the 120 VAC provided by the regulator. As such, the system 1 will continue to provide an accurate indication of the tap position should the 120 VAC become unavailable. The circuitry of the system 1 should preferably be designed for minimal power consumption to maximize operating time under back-up battery power. The backup battery 29 can be rechargeable and the power supply 28 can maintain the battery charged while the 120 VAC source is available.

FIG. 2 shows an exemplary display format for the tap position display 40 for use in the tap indication system of the present invention. As shown in FIG. 2, the display 40 includes a pointer element 45 for each tap position. At any one time, one pointer element 45 representing the current tap position is activated or on. Between adjacent pointer elements 45, the display 40 includes max/min display elements 47. At any one time, one max/min element 47 is turned on to show the minimum tap position value, and one max/min element 47 is turned on to show the maximum tap position value. As such, at least one and up to three display elements may be on at a given time. In the exemplary embodiment of FIG. 2, the display 40 includes 33 pointer elements 45 and 34 max/min elements 47 for a total of 67 display elements. The display 40 may also include alphanumeric indicia 49.

In an alternative embodiment of the display 40, the max/min elements 47 can be eliminated. In this case, the one pointer element 45 representing the present tap position is on steadily. Two other pointer elements 45, representing the maximum and minimum tap positions, respectively, flash repetitively. If the maximum or minimum tap position is the same as the present tap position, the pointer element 45 representing the present tap position stays on steadily. Such an embodiment of the display 40 includes only 33 display elements.

Figure 3:
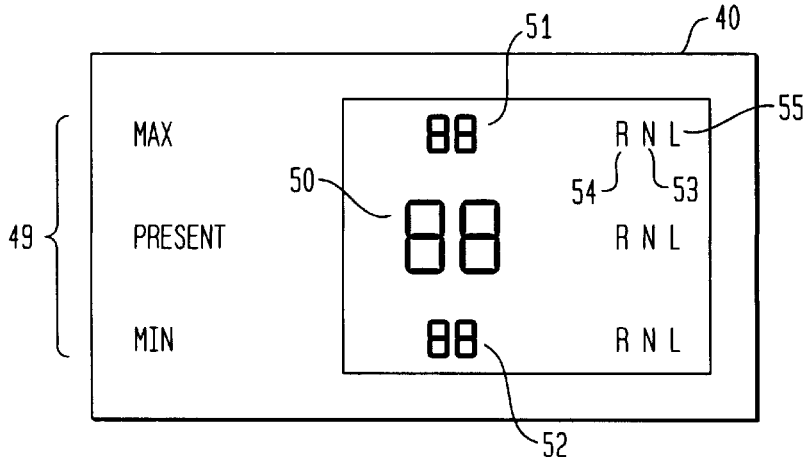
FIG. 3 shows a further exemplary display format of a tap position display in accordance with the present invention.

In an alternative exemplary embodiment of a display format, shown in FIG. 3, the present, maximum and minimum tap position values are displayed in an alphanumeric format by multisegment display elements 50, 51 and 52, respectively. For each value, three additional display elements 53, 54 and 55 are included to indicate whether the respective tap position is at the "neutral" (N) position, in a "raise" (R) position or in a "lower" (L) position, respectively.

The tap indication system 1 can be enclosed in a plastic enclosure with a transparent area on the top of the enclosure for viewing the display. To prevent condensation from building up and obscuring the display, the display 40 should be sealed to the transparent viewing area (which can be comprised, for example of a poly-carbonate). For outdoor applications, the assembled enclosure should preferably also be weatherproof, impervious to (solar) ultra-violet damage, and be able to endure temperatures in the range of −50° C. to +60° C.

The tap position indication system of the present invention can also include variable-amperage control. This function sets limits on the maximum and/or minimum tap changer positions, which sets the effective regulation range. With a reduced regulation range, the regulator can handle a higher current rating, thus the feature is known as "variable-amperage" or VARI-AMP.

Figure 4:
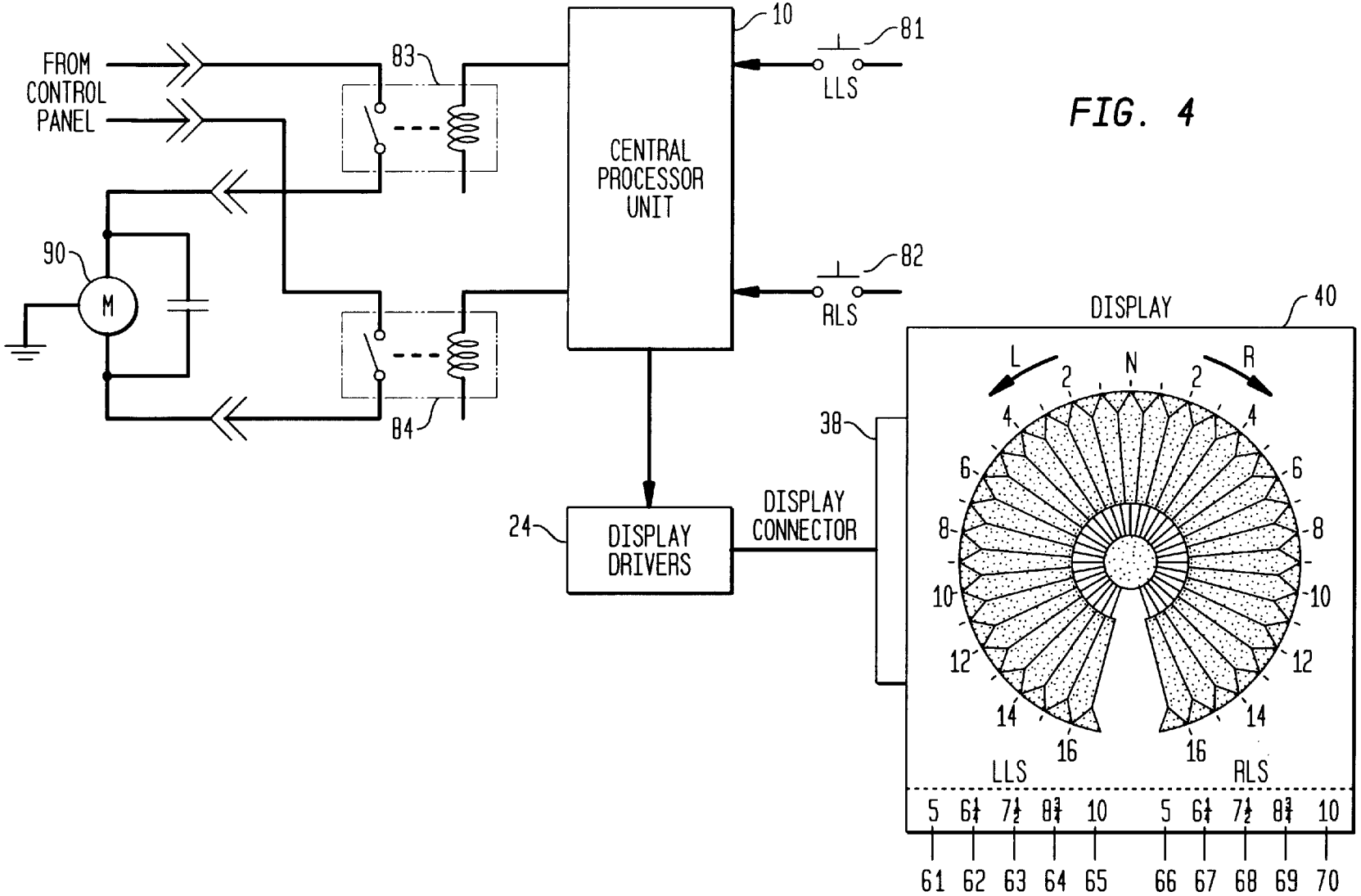
FIG. 4 is a partial block diagram of an exemplary embodiment of a system in accordance with the present invention having variable-amperage control functionality.

FIG. 4 is a partial block diagram of an exemplary embodiment of the system 1 of the present invention which provides variable-amperage control. For clarity, only those components involved with the variable-amperage control function are shown in FIG. 4.

In the embodiment of FIG. 4, a lower limit setting (LLS) switch 81 and a raise limit setting (RLS) switch 82 are included for setting limits on the amount that the tap changer motor 90 (in the tap changer mechanism) can respectively lower or raise the tap. The switch settings control the amount of regulation as a percentage of the system voltage. In accordance with established convention, the allowed settings are: 5%, 6¼%, 7½%, 8¾%, and 10%. 10% is preferably the default setting.

The CPU 10 monitors the activation of the switches 81 and 82. Pressing either switch 81 or 82 causes the CPU to cycle through the limit setting for the respective direction (lower or raise). For example, starting with the default setting of 10%, pressing switch 81 once causes the LLS to decrement to 8¾%. Further presses of the switch 81 causes the LLS to cycle down to 7½%, 6¼%, 5% and back to 10%. The CPU 10 maintains variables with values indicative of the LLS and RLS settings. These variables are stored in the non-volatile memory 16.

The CPU 10 uses the LLS and RLS settings to control switching devices 83 and 84, respectively. In the exemplary embodiment of FIG. 4, the switching devices 83 and 84 are relays, although other suitable switching devices may be used. The relays 83 and 84 are arranged in series with the tap changer motor 90 in the regulator system and with lower and raise control signals, respectively, provided from the regulator control panel (not shown). When the detected tap position reaches the lower limit setting, the CPU 10 opens the relay 83, thereby disabling the tap changer motor 90 from lowering the tap. Similarly, when the detected tap position reaches the raise limit setting, the CPU 10 opens the relay 84, thereby disabling the tap changer motor 90 from raising the tap.

The CPU 10 also controls the display 40 to display the selected LLS and RLS values so as to inform the user of the current settings. In the embodiment of FIG. 4, the display 40 includes additional display segments 61–65 for displaying the LLS setting and display segments 66–70 for displaying the RLS setting. One of the display segments 61–65 is activated at any given time to indicate the present LLS setting and one of the display segments 66–70 is activated at any given time to indicate the present RLS setting.

As an alternative or in addition to the LLS and RLS setting switches 81 and 82, the values of these settings can be provided to the system 1 via the data communications port 20, 22. The data communications port can also be used to provide the setting information to other devices. The ability to read or write the RLS and LLS settings from or to the system 1, makes the system conducive for use in remote control applications.

What is claimed is:

1. A tap position indication system comprising:

a tap position detection device, wherein the tap position detection device detects the position of a tap and generates position data indicative of the detected tap position;

a processor, wherein the processor is coupled to the tap position detection device and reads the position data; and a graphical electronic display, wherein the display is coupled to the processor and displays the detected tap position.

2. The system of claim 1, comprising a memory, wherein:

the processor stores a minimum and a maximum tap position in the memory, and the display displays the minimum and maximum tap positions.

3. The system of claim 2, wherein the processor resets the minimum and maximum tap positions in response to a reset signal.

4. The system of claim 1, wherein the tap position detection device includes:

a potentiometer, the potentiometer having a wiper which is mechanically coupled to a shaft whose rotational position is indicative of the tap position, wherein a voltage is developed on the wiper in accordance with the tap position; and an analog-to-digital (A/D) converter, the A/D converter having an analog input coupled to the wiper of the potentiometer and a digital output coupled to the processor.

5. The system of claim 1, wherein the tap position detection device includes an optical encoder.

6. The system of claim 1 comprising:

an input device, the input device being coupled to the processor; and a switching device, the switching device having a control input coupled to the processor and controlling the operation of a tap changer motor in accordance with the control input, wherein the processor sets a tap limit setting in accordance with the input device and controls the switching device in accordance with the tap limit setting.

7. The system of claim 6, wherein the display displays the tap limit setting.

8. The system of claim 1, comprising a data communications port, wherein the data communications port is coupled to the processor.

9. The system of claim 8, wherein the data communications port is used to communicate data values including at least one of a tap position value, a tap position maximum value and a tap position minimum value.

10. The system of claim 6, comprising a data communications port, wherein the data communications port is coupled to the processor and wherein the data communications port is used to communicate data values including the tap limit setting.

11. The system of claim 8, wherein the processor resets the minimum and maximum tap positions in response to a reset signal communicated via the data communications port.

12. The system of claim 1 comprising:

a data communications port, the data communications port being coupled to the processor; and a switching device, the switching device having a control input coupled to the processor and controlling the operation of a tap changer motor in accordance with the control input, wherein the processor sets a tap limit setting in accordance with data communicated via the data communications port and controls the switching device in accordance with the tap limit setting.

13. The system of claim 1, wherein the graphic display comprises a representation of a rotary mechanical display.

14. The system of claim 13, wherein the representation comprises a representation of mechanical drag-hands for denoting a minimum and a maximum tap position.

15. An electronic tap position indication system comprising:

a tap position detection device, wherein the tap position detection device detects the position of a tap and generates position data indicative of the detected tap position;

a processor, wherein the processor is coupled to the tap position detection device and reads the position data; and an electronic display, wherein the display is coupled to the processor and displays the detected tap position, the display device configured for direct outdoor viewing.

16. The system of claim 15, wherein the enclosure comprises plastic and further comprises a transparent portion for viewing the display.

17. The system of claim 16, wherein the transparent portion is sealed to the display.

18. The system of claim 16, wherein the enclosure is impervious to ultraviolet damage.

19. The system of claim 16, wherein the enclosure is able to endure temperatures in the range of −50 degrees C to +60 degrees C.

20. The system of claim 15, further comprising a memory, wherein:

the processor stores a minimum and a maximum tap position in the memory, and the display displays the minimum and maximum tap positions.

21. The system of claim 20, wherein the processor resets the minimum and maximum tap positions in response to a reset signal.

22. The system of claim 15, wherein the tap position detection device includes:

a potentiometer having a wiper which is mechanically coupled to a shaft whose rotational position is indicative of the tap position, wherein a voltage is developed on the wiper in accordance with the tap position; and an analog-to-digital (A/D) converter, the A/D converter having an analog input coupled to the wiper of the potentiometer and a digital output coupled to the processor.

23. The system of claim 15, wherein the tap position detection device includes an optical encoder.

24. The system of claim 15 comprising:

an input device, the input device being coupled to the processor; and a switching device, the switching device having a control input coupled to the processor and controlling the operation of a tap changer motor in accordance with the control input, wherein the processor sets a tap limit setting in accordance with the input device and controls the switching device in accordance with the tap limit setting.

25. The system of claim 24, wherein the display displays the tap limit setting.

26. The system of claim 15, comprising a data communications port, wherein the data communications port is coupled to the processor.

27. The system of claim 26, wherein the data communications port is used to communicate data values including at least one of a tap position value, a tap position maximum value and a tap position minimum value.

28. The system of claim 24, comprising a data communications port, wherein the data communications port is coupled to the processor and wherein the data communications port is used to communicate data values including the tap limit setting.

29. The system of claim 26, wherein the processor resets the minimum and maximum tap positions in response to a reset signal communicated via the data communications port.

30. The system of claim 15 comprising:

a data communications port, the data communications port being coupled to the processor; and a switching device, the switching device having a control input coupled to the processor and controlling the operation of a tap changer motor in accordance with the control input, wherein the processor sets a tap limit setting in accordance with data communicated via the data communications port and controls the switching device in accordance with the tap limit setting.

31. An electronic tap position indication system comprising:

a tap position detection device, wherein the tap position detection device detects the position of a tap and generates position data indicative of the detected tap position;

a processor, wherein the processor is coupled to the tap position detection device and reads the position data; and a graphical electronic display, wherein the display is coupled to the processor and displays the detected tap position, the display device being configured for direct outdoor viewing.

* * * * *